US005102023A

United States Patent [19]

Nguyen

[11] Patent Number: 5,102,023

[45] Date of Patent: Apr. 7, 1992

[54] CLOTHING ACCESSORY

[76] Inventor: Tuan D. Nguyen, 4212 Camargo Dr. (Apt. E), Dayton, Ohio 45415

[21] Appl. No.: 682,957

[22] Filed: Apr. 10, 1991

[51] Int. Cl.[5] ..... A44B 11/00; A44C 5/00

[52] U.S. Cl. ..... 224/163; 224/903; 224/180; 224/152; 24/163 K; 63/21

[58] Field of Search ..... 224/903, 163, 152, 170, 224/180, 224; 368/277, 278, 314; 63/21; 24/163 K

[56] References Cited

U.S. PATENT DOCUMENTS

| | | | |
|---|---|---|---|
| 1,278,866 | 9/1918 | Thompson | 224/199 |
| 1,383,968 | 7/1921 | Perry, Jr. et al. | 224/163 |
| 1,479,008 | 1/1924 | Powers | 224/152 |
| 2,124,945 | 7/1938 | Gross | 368/278 |
| 2,182,194 | 12/1939 | Blau | 224/163 |
| 2,509,428 | 5/1950 | Greene | 224/180 |
| 4,053,966 | 10/1977 | Dielman | 24/163 K |
| 4,326,280 | 4/1982 | Perry, Jr. | 224/163 |
| 4,536,094 | 8/1985 | Nagura | 224/163 |

FOREIGN PATENT DOCUMENTS

| | | | |
|---|---|---|---|
| 640000 | 12/1936 | Fed. Rep. of Germany | 29/3 F |
| 507348 | 6/1939 | United Kingdom | 368/277 |

*Primary Examiner*—Ernest G. Cusick
*Assistant Examiner*—Keith Kupferschmid
*Attorney, Agent, or Firm*—Joseph Patrick Burke

[57] ABSTRACT

A combination watch/waist belt capable of use with interchangeable faceplates and watches having an upside down, flip-up watch face spring hinged in its watch housing for the wearer's release to a time determining position at the wearer's will wherein the watch face can be read right side up by merely a downward glance by the wearer while the watch face is hingedly retained in a position normal to viz., approximatley 90° to, that of its housing. The watch is mounted on the central portion of the belt at the front of the wearer's waist. A quick release device located adjacent the watch housing, permits easy disengagement of a given faceplate and replacement with another thus offering the fashion conscious wearer a variety of belt/watch ensembles for fashion coordination. The present watch/waist belt can be worn by both sexes.

10 Claims, 3 Drawing Sheets

CLOTHING ACCESSORY

BRIEF DESCRIPTION OF THE INVENTION

The present invention is directed to a combination watch/waist belt capable of use with interchangeable faceplates and watches having an upside down, flip-up watch face spring hinged in its watch housing for the wearer's release to the time determining position at the wearer's will wherein the watch face can be read right side up by merely a downward glance by the wearer while the watch face is hingedly retained in a position normal to viz., approximately 90° to, that of its housing. The watch is mounted on the central portion of the belt at the front of the wearer's waist. Quick release means located adjacent the watch housing, permit easy disengagement of a given faceplate and replacement with another thus offering the fashion conscious wearer a variety of belt/watch ensembles for fashion coordination. The present watch/waist belt can be worn by both sexes.

BACKGROUND OF THE INVENTION AND PRIOR ART

There has long been desired a way of wearing one's watch which permits freedom of the use of both hands yet safeguards the watch from damage, as costly a possession as fine watches can be. Similarly it has been desired to enable color, design and style coordination of the watch with the wearer's wardrobe, mood, and social or business setting in which the watch is to be worn.

It is also desirable to be able to vary the type or design of watch in accordance with the wearer's activity, e.g., athletic or sedentary, while permitting frequency of observation of time to be readily controlled by the wearer. These and other objectives have led to various efforts in the prior art to attempt to accomplish such objectives, which objectives have been met with varying success by a variety of structures.

U.S. Pat. No. 1,383,968 issued to C. Perry, Jr., et al is directed to a watch belt buckle wherein a watch (15) is mounted within buckle (3) having circular opening (13) in belt (1) in a reverse upside down fashion with the dials and indicia numbers facing inwardly and concealed by the curved watch backplate (FIG. 1) which forms the outwardly curved central surface of the buckle. The front face (14) of watch (15) is retained by a snap catch (16) struck out of the top edge (16') which engages stem (17) of watch (15). The watch case is preferably provided with a hook portion (18) integral therewith hinged in recess (19) of the front side (5) intermediate of the belt buckle to retain the front face (14) of the watch in its reverse position within opening (13) when the watch is in its normal (closed) position. When the stem (17) is released from the catch (16), the front face of the watch flips down approximately 180° (FIG. 2) permitting the wearer to observe the time either by tilting his/her head downwardly, or by rotating buckle (3) or watch (15) upwardly; or by a combination of both maneuvers.

In the modified form (FIG. 6), a hook (18*a*) is placed on the bottom of watch (15*a*), which is hinged to a vertical pintle (19*a*) to which a hinge member (2*a*) is secured. In this form watch (15*a*) lies entirely within the buckle, and belt (1*a*) passes through the buckle and in back of the watch. Then the wearer must turn the buckle away from his/her body to observe the time. Note that in this modification, the watch stem is mounted parallel to the long axis of the belt and no provision is made for flip down of the watch front face.

U.S. Pat. No. 1,382,256 issued to L. Tomchin is directed to a watch that is readily convertible into a wrist watch or pendant for wear either around the wrist or neck. There is no teaching in Tomchin of a waist watch. Tomchin is directed to an interchangeable pendant watch (FIG. 1) or a wrist watch (FIGS. 2 & 5) due to the provision of detachable coupling devices permitting attachment of the watch to flexible connections adapting it either for wrist or neck wear. A plurality of differently positioned peripheral coupling shoulders (c, c) on watch casing (C) via coupling members (A, A) or (A) enable the Tomchin watch to be used as a wrist or pendant watch, respectively. Watch (W) is shown mounted upside down as a pendant watch (FIG. 1) and wrist watch (FIGS. 2 & 5).

U.S. Pat. No. 2,182,194 issued to A. S. Blau is directed to a watch mounting which is a belt, or strap of a wrist watch (right col., 11. 7–9). The watch (12) having a side stem (14) has a case of any desired shape/configuration desirably shaped for special cooperation with mounting member plate (10). The Blau watch face is concealed and faces inwardly as worn. Watch (12) is mounted with its face surface in contact with the front face of plate (10) & secured to it by a hinge (16), one-half of which is fixed with the front face of (10) & the other half of which is fixed with the case of watch (12). Torsion spring means (18) cooperates with the two halves of hinge (16) to tension watch 12 normally urging it to swing toward one limit of its pivotable position. Catch means includes spring arm (20) secured to plate (10) opposite from hinge (16), and has struck tooth portion 22) cooperating with abutment (24) at the upper edge of the watch to hold it in its normal position. To observe time, the wearer presses the outer end of catch (20) outwardly away from watch (12) thus releasing tooth (20) from abutment (24). Watch (12) then swings downwardly and outwardly about its hinge axis to its dotted line position thus exposing the face of watch (12).

Ordinarily it will be desirable that hinge structure (16) be on the far side of the watch from the eye of the wearer when the watch is positioned to be read so that in opening up its face will be brought into substantially perpendicular relationship with respect to the wearer's line of vision (page 3, left col., 11. 18–24).

U.S. Pat. No. 1,278,866 issued to R. A. Thompson is directed to a belt-watch holder designed for clipping on a waist belt adjacent to its belt buckle. Watch (3) is contained in generally rectangular oblong holder (2) and secured to belt (1) and held in place via clasp member (10) and companion clasp member (11) of attaching strap (8). Outer strip (member) (4) of holder (2) is provided with a central annular flange or rim (12). Watch (3) can be mounted upside down as show in FIG. 1. No mechanism is provided, contemplated, or apparently feasible within the framework of the Thompson structure to flip watch (3) up ~90° for permitting the wearer to check the time with merely a downward glance. There is no stated provision made for fashion coordination of watch face, with belt or wearer's clothing, eye color, etc. There is no contemplation of a readily removable connection of buckles.

U.S. Pat. No. 3,272,410 issued to E. Reisman is directed to a key belt which can have a watch (21) substituted for the wearer's house key (FIGS. 5 and 6). The watch casing is secured to a mounting plate (20) one end (20*a*) of which is bent or crimped about the outer portion of a loop member (11') and the other end of the mounting plate is bent in the form of a hook (20*b*) adapted to be passed through the other loop member (12') of the belt. The watch (21) serves a non-fastening function of the main belt buckle.

DETAILED DESCRIPTION OF THE INVENTION

Figures 1, 2, 3, 4, 5, 6, 7:
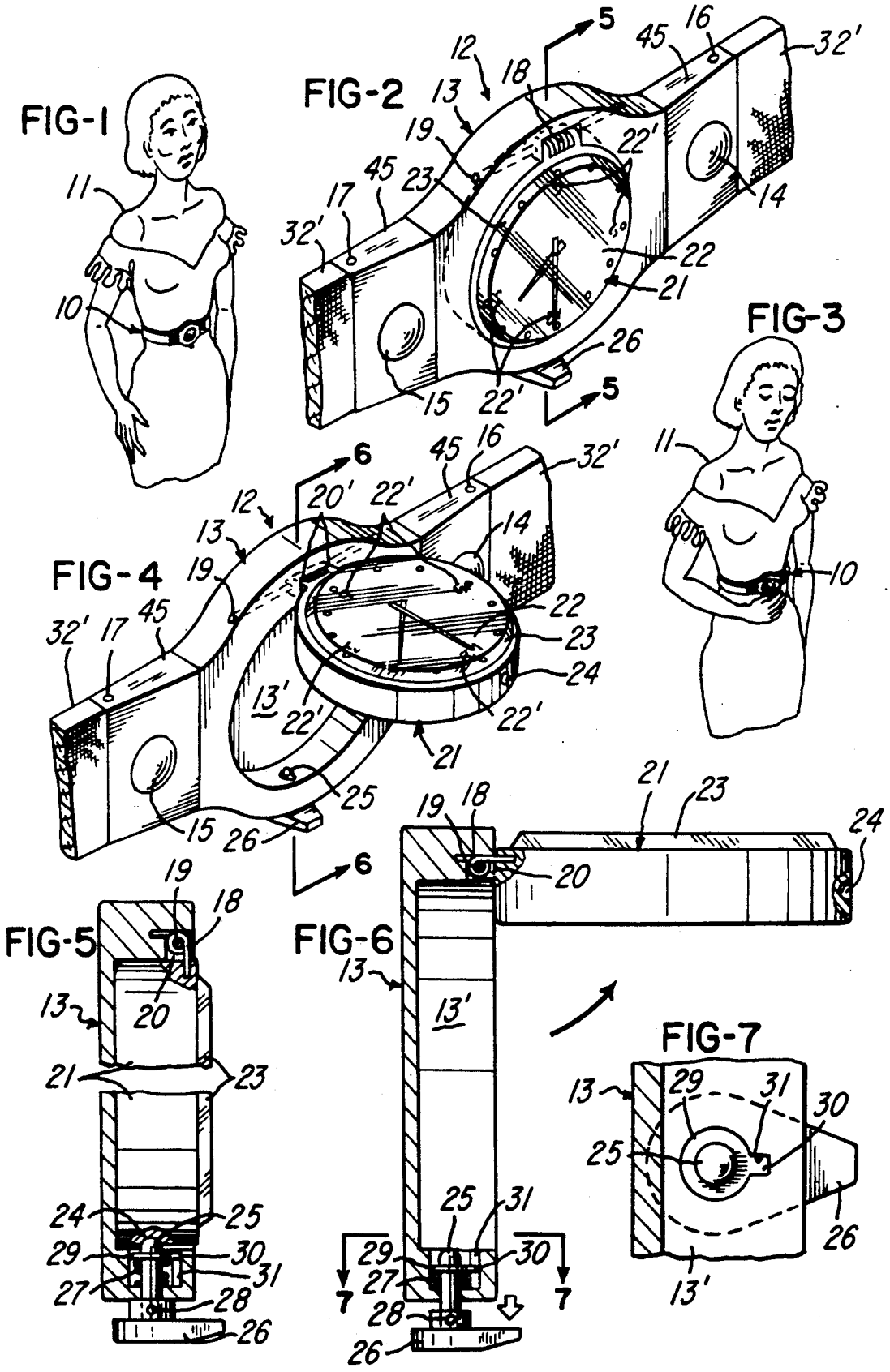
FIG. 1 is a perspective view of the environment in which the watch/waist belt of the present invention is worn.
FIG. 2 is a fragmentary perspective view of the watch/waist belt of the present invention with parts in section.
FIG. 3 is a perspective view of the environment in which the watch/waist belt of this invention is activated by the wearer to the time determining position.
FIG. 4 is a fragmentary perspective view with parts in section showing the watch in its time determining position.
FIG. 5 is a cross sectional fragmentary view taken along the lines 5—5 of FIG. 2 showing portions of the watch release and hinging mechanisms.
FIG. 6 is a cross sectional view taken along the line 6—6 of FIG. 4 showing the watch flipped up in time determining position.
FIG. 7 is a partial sectional view taken along the line 7—7 of FIG. 6 showing portions of the release tab and key tab mechanism with its spring retainer.

As will be apparent from FIGS. 1–4, watch/waist belt 10 is worn around the waist of wearer 11 with its faceplate 12 at the wearer's front in manner with the dial numbers 22' in an upside down position, viz., with the dial numeral 12 at the bottom and the numeral 6 at the top while the watch 21 is in its housing 13. Note FIG. 2 in this regard.

Figure 8:
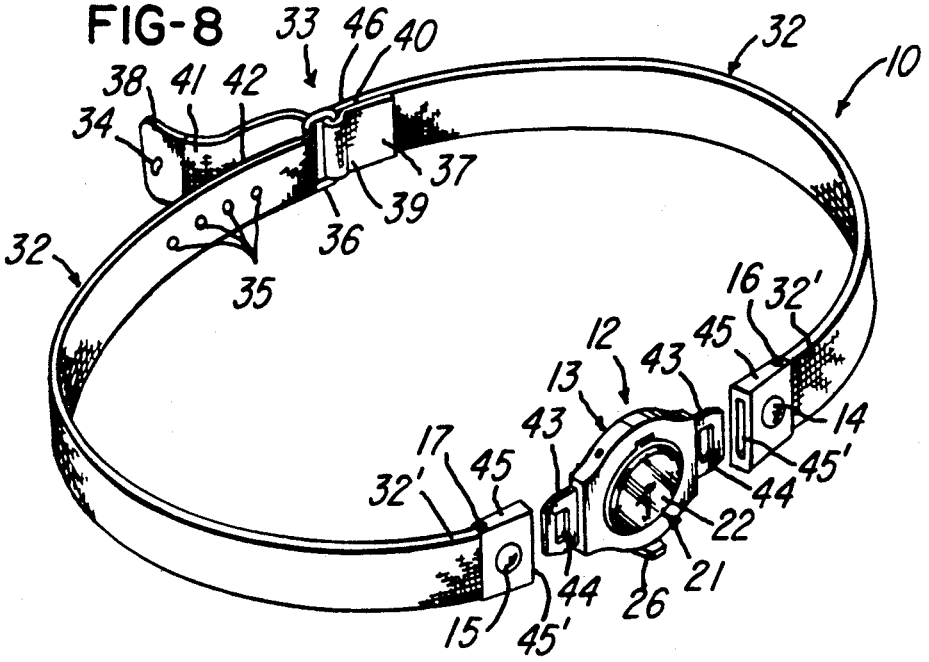
FIG. 8 is a perspective view of the interchangeable watch face plate and watch housing separated from the belt buckles.
Figure 9:
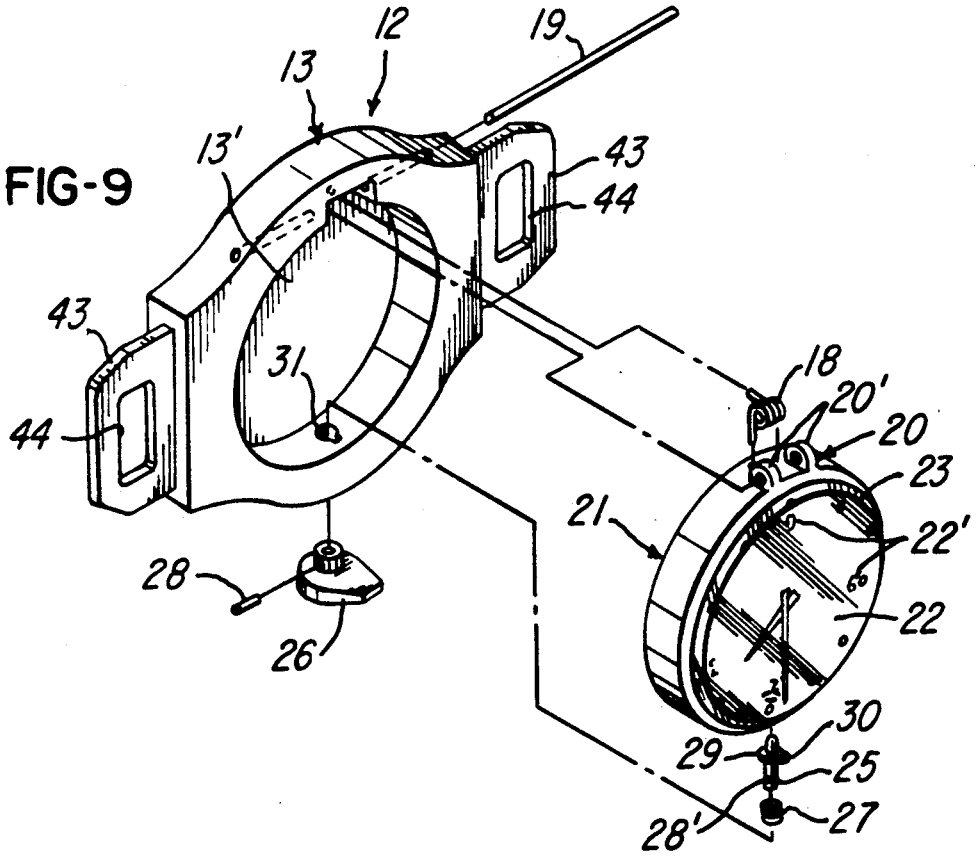
FIG. 9 is a diagrammatic exploded view of the watch face plate and housing with its hinge and release tab means.

The watch face plate 12 can be removed easily from its adjacent buckle members 45 as illustrated in FIGS. 2, 4 and 8 by simply pressing on quick release left hand and right hand face plate release means 14 and 15, respectively. This detaches (releases) fasteners 43, which can be substantially "D-shaped" male fastener ears having openings 44, from their slotted buckle members 45, which, e.g., can be female slotted buckle elements containing readily engageable and disengageable keeper catches (not shown) for interior engagement with fasteners 43 via their openings 44. Upon exerting downward pressure on release buttons 14, 15, disengagement (release) occurs. Conversely insertion of male ears 43 into slots 45' engages the latches in openings 44 thereby retaining the fasteners 43 within slots 45 much like some automobile and airplane seat belts.

When the wearer desires to view the time of day, he/she simply presses downward on release tab 26 compressing compression spring 27 downwardly releasing spring-loaded catch 25, FIGS. 4–6 and 9, causing it to dislodge from detent 24 located in the lower center portion of watch 21. This permits watch face 22 with its corresponding crystal 23 to flip up towards the eyes of wearer 11 via the action of torsion spring means 18, e.g., a coil spring, anchored by spring anchor means 19, e.g., a hinge pin, and escape for its case opening or space 13'. A pair of adjacent hinges 20 (See FIG. 6 and 9) permit watch face 22 to flip up approximately 90° to a position normal to its housing 13 where the upper ledges 20' (FIGS. 4 and 9) of hinges 20 prevent further upward movement. Release tab 26 faces forward due to the shape of the keyway 31 in watch housing 13 lower portion.

As is apparent from FIG. 4–6 and 9, catch retaining pin 28 inserted in opening 28' keeps spring loaded catch 25, which functions as a combination release and retention pin, fixed in position within collar 29 held by release tab 26. Guide key 30 with its slotted bore keyway 31 will keep upside down, flip-up watch face 22 in its normal locked position once the wearer glances down, observes the time (FIGS. 3, 4 and 6) and returns watch face 22 to its downward position to seat catch 25 in detent 24.

Figure 10:
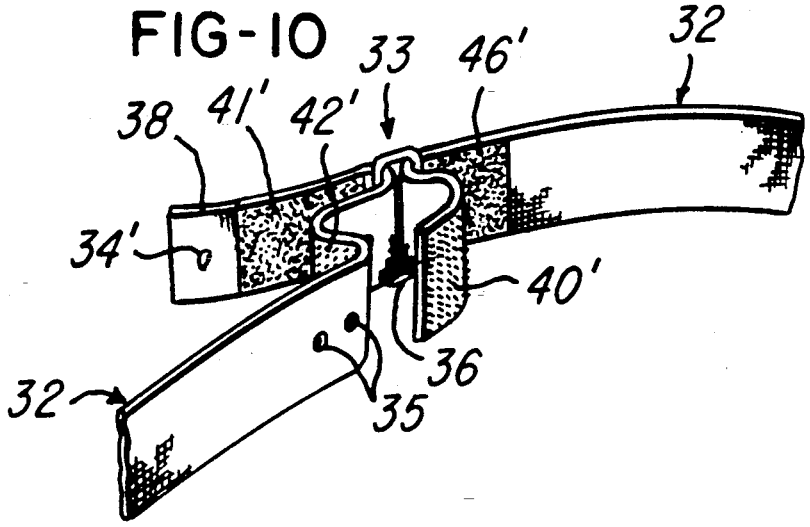
FIG. 10 is a perspective view as in FIG. 8 of a portion of the rear of the watch waist belt.

As shown in FIGS. 2, 4 and 8, left hand and right hand belt pins 16 and 17, respectively, can be used to retain those front facing portions 32' of belt 32 in position in buckles 45. At the rear of the belt around the wearer's waist, belt size adjustments means 33 (FIG. 8) includes an y suitable means, e.g., a conventional belt buckle; or the means shown in FIGS. 8 and 10, a curved or elbow shaped position setting hook 34 or pin 34' adapted for insertion into any one of position determining openings 35. Hook or curved pin 34 can be located conveniently on the belt right rear distal end 38 which is passed through closed loop 36, attached to belt rear left hand distal end 37, prior to insertion into one of openings 35. The attachment of that portion 39 of distal end 37 which is looped through the left hand facing portion of loop 36 can be reinforced in a readily releasable manner by providing its interior facing portion 40 with a Velcro-type mating hook or pile fiber layer or structure to permit it to mate with a corresponding pile 46' or hook 40 layer or structure on the adjacent portion 46 of belt 32 adjacent its distal end 37 but which does not pass through loop 36. Similarly that portion 41 of belt 32 adjacent to its distal end 38 can be a Velcro-type hook 42' or pile 41' layer or material to mate with portion 42 of belt 32 and readily releasably reinforce any selected positioning of pin 34 in an y opening 35.

The watch case, per se, can serve as a buckle for attachment to the front ends of the belt. Moreover, instead of having two front belt portions, the belt can be a single piece and wrapped/passed through and around the rear surface of the watch housing (case).

Thus there has been provided a watch waist belt comprising a readily releasable, removable watch housing; a watch attached to said housing such that a watch face of the watch is positioned upside down within said housing with its dial numerals in upside down position and visible; torsion spring means located in an upper portion of said housing anchored by a releasable hinge pin positioned between hinges on said watch causing movement from a storage position in which the watch is located within the housing to a time viewing position in which the readily releasable, removable watch face to flip up toward the eyes of the wearer approximately 90° from a lateral axis of the watch housing; a detent located in a bottom central portion of the watch; a compression spring loaded catch, one end of which fits in the detent and the other end of which is attached to a release tab, the downward engagement of which by the wearer downwardly releases the catch from said detent permitting the watch and watch face to flip up to the time viewing position due to the action of the torsion spring means; and a waist belt, to be worn around a wearer's waist, and having a front portion releasably attached to the watch housing and a rear portion containing belt sizing adjustment means.

I claim:

1. A watch waist belt comprising a readily releasable, removable watch housing; a watch attached to said housing such that a watch face of the watch is positioned upside down within said housing with its dial numerals in upside down position and visible; torsion spring means located in an upper portion of said housing anchored by a releasable hinge pin positioned between hinges on said watch causing movement from a storage position in which the watch is located within the housing to a time viewing position in which said watch face is approximately 90° from a lateral axis of said watch housing; a detent located in a bottom central portion of said watch; a spring loaded catch, one end of which fits in said detent and the other end of which is attached to a release tab, the engagement of which releases said catch from said detent permitting the watch and watch face to flip up to the time viewing position due to the action of said torsion spring means; and a waist belt, to be worn around a wearer's waist, and having a front portion releasably attached to said watch housing and a rear portion including belt sizing adjustment means.

2. A watch waist belt as in claim 1 wherein said watch is readily releasable from its housing.

3. A watch waist belt as in claim 1 wherein said watch housing is readily releasably attached to the front portion of said belt by attachment to a pair of buckle members adjacent to said watch housing and wherein said buckle members are, in turn, each releasably attached to the front portion of said belt.

4. A watch waist belt as in claim 3 wherein each buckle member includes quick release means operable by pressure to cause detachment of said watch housing from said buckle members.

5. A watch waist band as in claim 3 wherein said belt is a two piece belt and each buckle member is attached to a corresponding front portion of said belt by a pin.

6. A watch waist belt as in claim 1 wherein said rear portion includes first and second rear end portions and said belt sizing adjustment means includes a position setting hook or pin on the first rear end portion engageable within one of a plurality of position determining openings located on the second rear end portion.

7. A watch waist belt as in claim 6 wherein said belt sizing adjustment means includes readily releasable mating Velcro-type hook and pile members on said first and second rear end portions for reinforcing the hook and opening engagement.

8. A watch waist belt as in claim 1 wherein said belt is a two piece belt.

9. A watch waist band as in claim 1 wherein said engagement of said spring loaded catch is in a downward direction.

10. A watch waist band as in claim 1 wherein said hinges are a pair of adjacent hinges having upper ledges which prevent further upward movement of said watch past approximately 90° during its flip upwardly to the time determining position.

* * * * *